US011233322B2

(12) United States Patent
Wakabayashi

(10) Patent No.: US 11,233,322 B2
(45) Date of Patent: Jan. 25, 2022

(54) COMMUNICATION DEVICE

(71) Applicant: Sony Interactive Entertainment Inc., Tokyo (JP)

(72) Inventor: Minoru Wakabayashi, Tokyo (JP)

(73) Assignee: Sony Interactive Entertainment Inc., Tokyo (JP)

( * ) Notice: Subject to any disclaimer, the term of this patent is extended or adjusted under 35 U.S.C. 154(b) by 0 days.

(21) Appl. No.: 16/765,211

(22) PCT Filed: Nov. 30, 2018

(86) PCT No.: PCT/JP2018/044238
§ 371 (c)(1),
(2) Date: May 19, 2020

(87) PCT Pub. No.: WO2019/107553
PCT Pub. Date: Jun. 6, 2019

(65) Prior Publication Data

US 2020/0280126 A1 Sep. 3, 2020

(30) Foreign Application Priority Data

Nov. 30, 2017 (JP) ..... JP2017-230134

(51) Int. Cl.
*H01Q 9/42* (2006.01)
*H01Q 1/52* (2006.01)
*H01Q 1/24* (2006.01)

(52) U.S. Cl.
CPC ..... *H01Q 1/52* (2013.01); *H01Q 1/242* (2013.01); *H01Q 9/42* (2013.01)

(58) Field of Classification Search
CPC ..... H01Q 1/52; H01Q 1/242; H01Q 9/42; H01Q 1/38
See application file for complete search history.

(56) References Cited

U.S. PATENT DOCUMENTS 7,352,328 B2 4/2008 Moon
2007/0069960 A1 3/2007 Moon
(Continued)

FOREIGN PATENT DOCUMENTS

JP 2007097167 A 4/2007
JP 2012182726 A 8/2012
(Continued)

OTHER PUBLICATIONS

International Preliminary Report on Patentability and Written Opinion for corresponding PCT Application No. PCT/JP2018/044238, 11 pages, dated Jun. 11, 2020.
(Continued)

*Primary Examiner* — Graham P Smith
(74) *Attorney, Agent, or Firm* — Matthew B. Dernier, Esq.

(57) ABSTRACT

A communication device includes a first antenna and a second antenna that perform wireless communication in frequency bands that at least partly overlap each other, in which each of the first antenna and the second antenna includes a body part that resonates in a frequency band that is a target of the wireless communication with the each of the first antenna and the second antenna, and a branch part that branches from the body part. Each of the ranch part of the first antenna and the branch part of the second antenna includes a coupling part, the coupling part in the first antenna and the coupling part in the second antenna being disposed with an interval left to cause capacitive coupling.

5 Claims, 9 Drawing Sheets

(56) References Cited

U.S. PATENT DOCUMENTS

| | | | | |
|---|---|---|---|---|
| 2011/0050528 | A1 | 3/2011 | Montgomery | |
| 2015/0061962 | A1* | 3/2015 | Lee | H01Q 1/521 343/893 |
| 2015/0180117 | A1 | 6/2015 | Ruan | |

FOREIGN PATENT DOCUMENTS

| | | | |
|---|---|---|---|
| JP | 2013504260 | A | 2/2013 |
| JP | 2013126120 | A | 6/2013 |
| WO | 2011028801 | A2 | 3/2011 |

OTHER PUBLICATIONS

International Search Report for corresponding PCT Application No. PCT/JP2018/044238, 2 pages, dated Feb. 5, 2019.
Decision to Grant for corresponding JP Application No. JP2019-556755, 5 pages, dated May 21, 2021.
Supplementary European Search Report for corresponding EP Application No. 18883585, 10 pages, dated Jul. 21, 2021.

* cited by examiner

COMMUNICATION DEVICE

TECHNICAL FIELD

The present invention relates to a communication device including an antenna for wireless communication.

BACKGROUND ART

Some communication devices for wireless communication include a plurality of antennas in order to correspond to a plurality of standards or to improve communication quality. For example, there is a known communication device including both of an antenna conforming to a Bluetooth (registered trademark) standard and an antenna conforming to the wireless local area network (LAN) standard. Furthermore, in multiple-input and multiple-output (MIMO) technology, a plurality of antennas is used for single wireless communication connection.

SUMMARY

Technical Problems

In the above-described conventional communication device, when the plurality of antennas transmits and receives radio waves in the same frequency band, mutual interference occurs between the antennas, thereby deteriorating communication performance, in some cases. To prevent such interference and improve isolation between the antennas, there is a known technique such as an increase in physical distance between the antennas or provision of stub between the antennas. However, such a technique has constraint such as necessity of a wide space in the device or a complicated structure.

The present invention has been made in consideration of the above-described situation, and one of its objects is to provide a communication device that uses a relatively saved space and can readily suppress the interference between the antennas.

Solution to Problems

A communication device according to the present invention includes a first antenna and a second antenna that perform wireless communication in frequency bands that at least partly overlap each other. Each of the first antenna and the second antenna includes a body part that resonates in a frequency band that is a target of the wireless communication with the each of the first antenna and the second antenna, and a branch part that branches from the body part. Each of the branch part of the first antenna and the branch part of the second antenna includes a coupling part, the coupling part in the first antenna and the coupling part in the second antenna being disposed with an interval left to cause capacitive coupling.

DESCRIPTION OF EMBODIMENTS

Hereinafter, embodiments of the present invention will be described in detail with reference to the drawings.

First Embodiment

Figure 1:
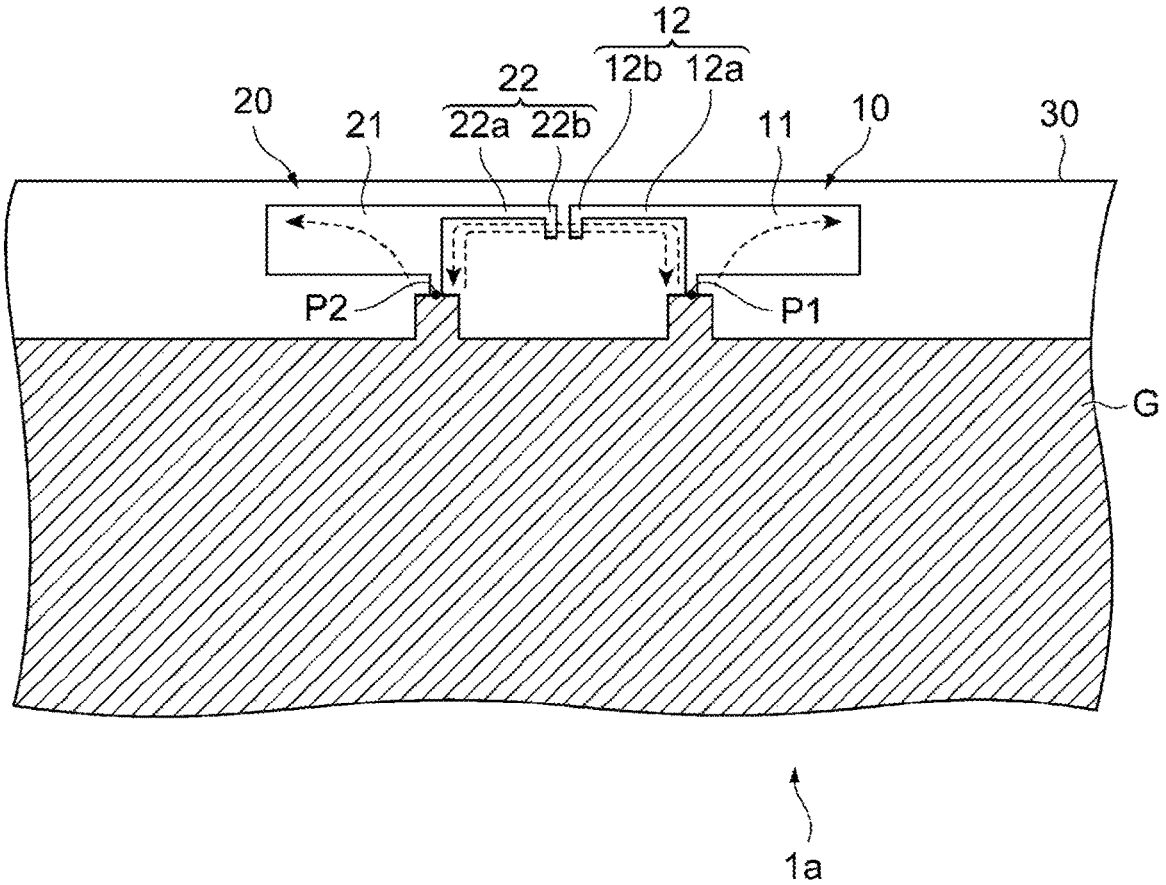
FIG. 1 is a plan view schematically illustrating an internal configuration of a communication device according to a first embodiment of the present invention.

FIG. 1 is a plan view schematically illustrating a state of a plurality of antennas disposed inside a communication device 1*a* according to a first embodiment of the present invention. Examples of the communication device 1*a* include a personal computer, a stationary game console, a portable game console, a smartphone, and a tablet computer. The communication device 1*a* includes a first antenna 10, a second antenna 20, and a substrate 30.

Each of the first antenna 10 and the second antenna 20 transmits and/or receives a wireless signal (electromagnetic wave), and is used to cause the communication device 1*a* to wirelessly communicate with another communication device. In the present embodiment, the first antenna 10 and the second antenna 20 transmit and receive wireless signals whose frequency bands at least partly overlap each other. For example, one of the first antenna 10 and the second antenna 20 may be used for wireless LAN communication based on Institute of Electrical and Electronics Engineers (IEEE) 802.11 standards, and the other of the first antenna 10 and the second antenna 20 may be used for Bluetooth communication. Alternatively, both the first antenna 10 and the second antenna 20 may be used for communication with the same standard such as the wireless LAN or Bluetooth based on a technology, for example, MIMO. Alternatively, the first antenna 10 and the second antenna 20 may be used for communication in predetermined frequency bands that partly overlap each other, such as band 12 and band 17 in long term evolution (LTE). Alternatively, the first antenna 10 and the second antenna 20 may be used for mutually different applications in which, for example, one is for transmission and the other is for reception based on a common communication standard.

Hereinafter, a frequency band of a wireless signal that is used by each of the first antenna 10 and the second antenna 20 for transmission and reception is referred to as a target frequency band. In the present embodiment, target frequency bands of the first antenna 10 and the second antenna 20 are assumed to be substantially equal to each other, and to be frequency bands around 5 GHz.

The substrate 30 is a circuit substrate on which an electronic circuit that processes the wireless signals transmitted and received by the first antenna 10 and the second antenna 20 is mounted, for example. A hatched portion in FIG. 1 indicates a region formed with the ground (reference potential) of the substrate 30 (hereinafter, referred to as a ground pattern G). The first antenna 10 and the second antenna 20 are each configured with a conductor formed in a planer shape in a region where no ground is formed on an outer edge of the substrate 30. The first antenna 10 and the second antenna 20 are connected to the reference potential that is common. A point P1 and a point P2 in FIG. 1 indicate positions of feeding points of the first antenna 10 and the second antenna 20, respectively.

Hereinafter, features of the first antenna 10 and the second antenna 20 in the present embodiment will be described. As illustrated in FIG. 1, the first antenna 10 includes a body part 11 and a branch part 12.

The body part 11 is a part for transmitting and receiving a wireless signal, which is an original object of the first antenna 10, and has a size and shape for resonating with the wireless signal in the target frequency band. In the present embodiment, the body part 11 has a rectangular shape that extends opposite to the second antenna 20 from the feeding point P1, and functions as a monopole antenna.

The branch part 12 has an elongated rod shape that branches and protrudes from the body part 11. More specifically, the branch part 12 is formed while branching from a side, of the body part 11, closer to the second antenna 20. The branch part 12 is formed to protrude toward the second antenna 20 from an end, of the body part 11, opposite to a side of the feeding point P1 (i.e., a side closer to the ground). The branch part 12 includes an extending part 12*a* that extends from the body part 11 toward the second antenna 20 (i.e., along a direction in which the first antenna 10 and the second antenna 20 are aligned) with a substantially constant width, and a coupling part 12*b* connected to a tip of the extending part 12*a*. In other words, the coupling part 12*b* is disposed at a position closest to the second antenna 20. The coupling part 12*b* has a shape that bends at the tip of the extending part 12*a* and extends toward the ground. With the extending part 12*a* and the coupling part 12*b*, the branch part 12 is formed in a substantially L shape as a whole. The coupling part 12*b* has a length shorter than a height of the body part 11 and a length of the extending part 12*a*, and is disposed along a direction facing the second antenna 20. With this configuration, a width along an extending direction of the branch part 12 as a whole is made wider at a coupling position (a position, of the coupling part 12*b*, closest to the second antenna 20) than at a branch position (a position where the extending part 12*a* is connected to the body part 11).

Similar to the first antenna 10, the second antenna 20 also includes a body part 21 and a branch part 22. The branch part 22 includes an extending part 22*a* and a coupling part 22*b*. As illustrated in FIG. 1, the second antenna 20 has a shape formed by laterally inverting the first antenna 10 as a whole, and is disposed to be in line symmetry with the first antenna 10. The body part 21 and the branch part 22 respectively function similar to the body part 11 and the branch part 12 in the first antenna 10.

Particularly, in the present embodiment, the branch part 22 branches from the body part 21 to protrude toward the first antenna 10. The coupling part 22*b* formed at a tip of the branch part 22 is disposed to face the coupling part 12*b* of the first antenna 10. Specifically, the coupling part 12*b* and the coupling part 22*b* are disposed with an interval therebetween. In addition, a distance between the coupling part 12*b* and the coupling part 22*b* is relatively short, so that the coupling part 12*b* and the coupling part 22*b* are adjacent to each other. This causes capacitive coupling between the coupling part 12*b* and the coupling part 22*b*. In the present embodiment, the coupling part 12*b* and the coupling part 22*b* are disposed to face each other in an identical plane (herein, a plane including the first antenna 10 and the second antenna 20).

With the above-described configuration, the first antenna 10 and the second antenna 20 resonate in four kinds of resonance modes in total. Profiles of those resonance modes are indicated by broken line arrows in FIG. 1. Specifically, the body part 11 of the first antenna 10 causes resonance in a first resonance mode. This resonance achieves wireless communication in the target frequency band with the first antenna 10. Moreover, the body part 21 of the second antenna 20 causes resonance in a second resonance mode. This resonance achieves wireless communication in the target frequency band with the second antenna 20.

Furthermore, resonance in a third resonance mode that runs from the feeding point P1 of the first antenna 10 toward the feeding point P2 of the second antenna 20, via the body part 11 and branch part 12 of the first antenna 10, the capacitive coupling between the coupling part 12*b* and the coupling part 22*b*, and the branch part 22 and the body part 21 of the second antenna 20 is caused. In addition, resonance in a fourth resonance mode is caused in a direction opposite to the third resonance mode. The resonance in the third and fourth resonance modes includes a frequency component close to or overlapping that of the resonance in the first and second resonance modes, and therefore exerts an effect for canceling influence of the resonance in the first and second resonance modes on the other antenna. Specifically, the third resonance mode exerts an effect on the second antenna 20 for canceling influence caused by the first resonance mode. The fourth resonance mode exerts an effect on the first antenna 10 for canceling influence caused by the second resonance mode.

In other words, by disposing, in each antenna, the branch part that branches from the body part for causing the resonance that is an original object and is capacitively coupled to the other antenna, an effect that reduces influence on the other antenna can be obtained. With this configuration, the antennas themselves can improve isolation between the antennas without separately disposing stub or other components outside the antennas. Moreover, the first antenna 10 and the second antenna 20 need to be disposed closer to each other in some extent, to cause those antennas to be capacitively coupled to each other. Therefore, when this configuration is used, the distance between the first antenna 10 and the second antenna 20 need not to be increased largely.

Figure 2A:
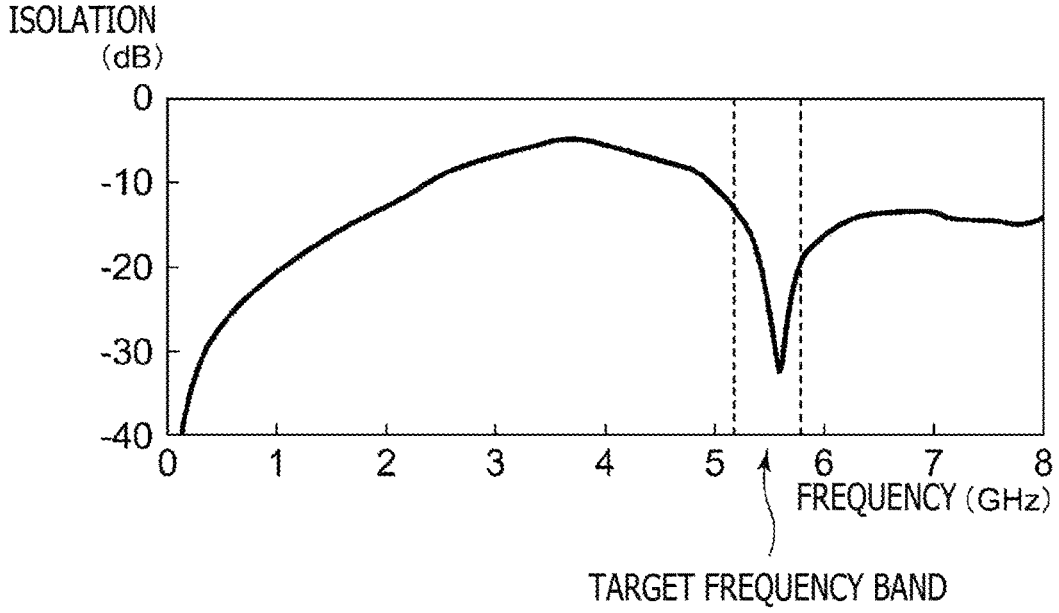
FIG. 2A is a graph illustrating isolation performance between antennas of the communication device according to the first embodiment of the present invention.
Figure 2B:
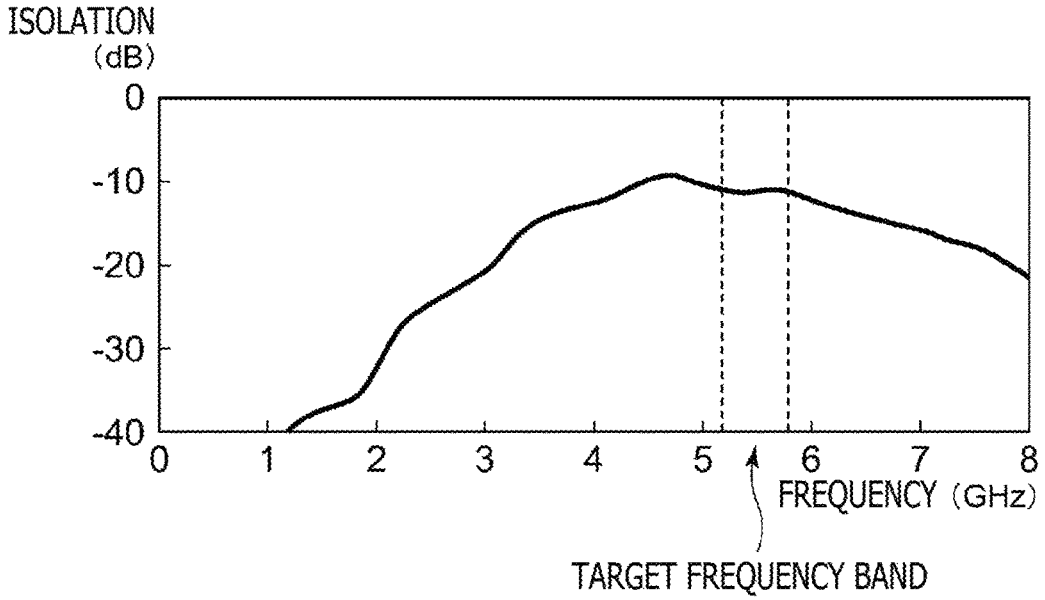
FIG. 2B is a graph illustrating isolation performance between antennas when a configuration of an embodiment of the present invention is not included.

FIG. 2A is a graph illustrating an investigation result of isolation performance between the antennas in the present embodiment through simulations. A horizontal axis of the graph indicates a frequency, and a vertical axis indicates a value of isolation. It is indicated that, the smaller the value in the vertical axis is, the more the isolation between the antennas is secured. For the purpose of comparison, FIG. 2B illustrates a simulation result of a case where two antennas respectively configured with only the body parts, without providing the branch part 12 and the branch part 22, are disposed similar to the present embodiment. As illustrated in FIGS. 2A and 2B, it is understood that, according to the present embodiment, the isolation is improved in the target frequency band (a frequency band around 5 GHz).

Figure 3:
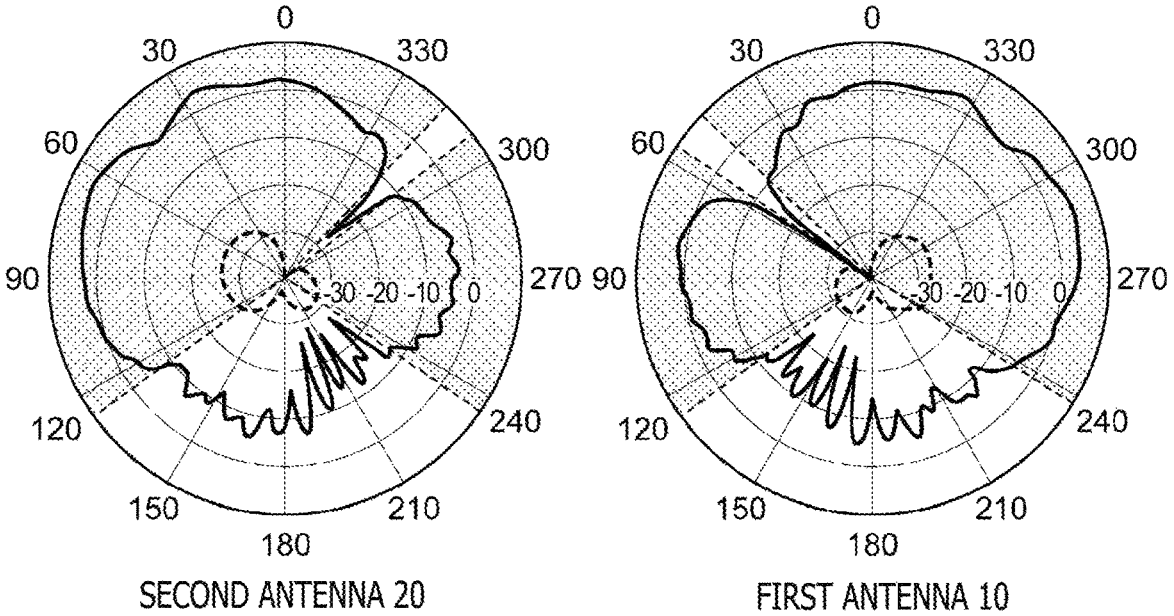
FIG. 3 is a view illustrating a directionality of each antenna in the first embodiment of the present invention.
Figure 4:
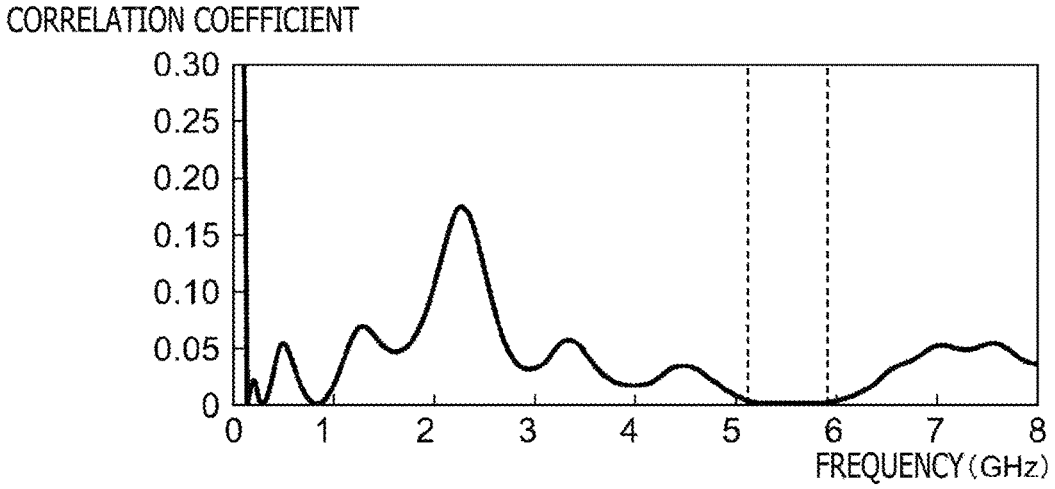
FIG. 4 is a graph illustrating correlation between the antennas in the first embodiment of the present invention.

When this configuration is used, the first antenna 10 and the second antenna 20 are bisymmetrically disposed. Therefore, directionalities of the antennas are also substantially symmetrical. FIG. 3 illustrates a directionality of each of the first antenna 10 and the second antenna 20. With such a characteristic, a correlation coefficient between the antennas can be reduced to be low in the target frequency band. FIG. 4 indicates the correlation coefficient between the first antenna 10 and the second antenna 20.

The inventor of the present application further studied a change in isolation performance by simulations when parameters relating to, for example, a shape and a disposed position of each antenna is changed. Results of the study will be described below.

Figure 5:
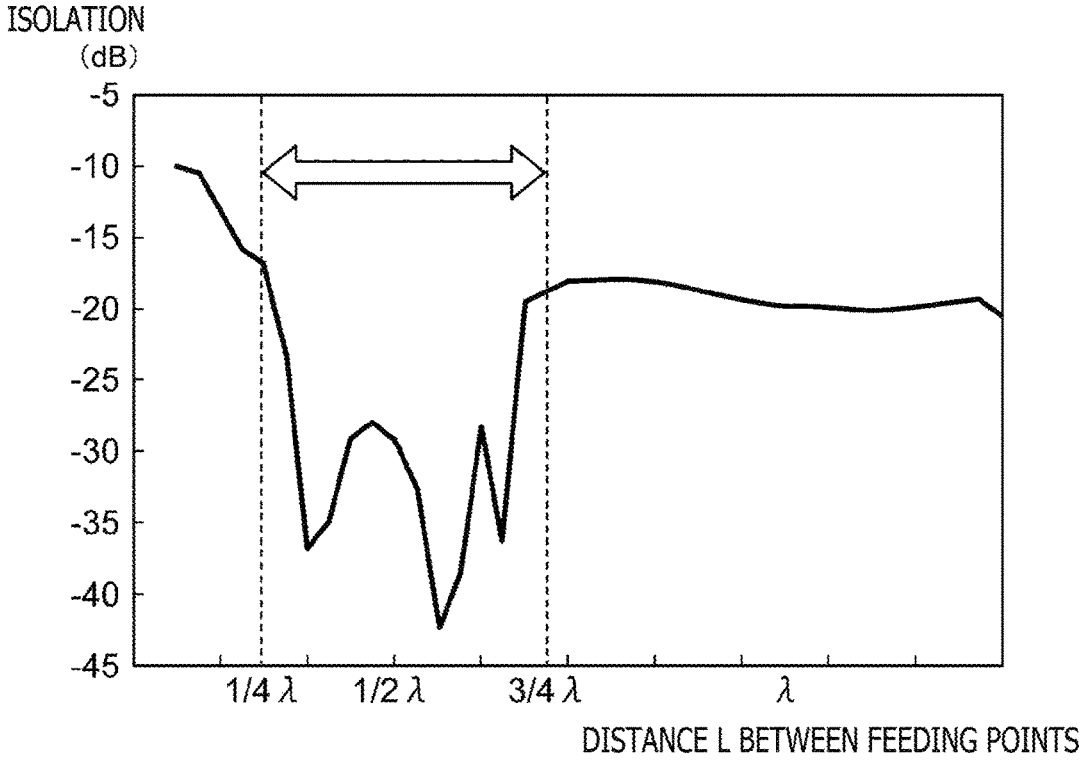
FIG. 5 is a graph illustrating a change in isolation performance when a distance between feeding points is changed.

FIG. 5 illustrates a change in isolation performance when a distance between the feeding point P1 of the first antenna 10 and the feeding point P2 of the second antenna 20 (hereinafter, referred to as a distance L between feeding points) is changed. In this graph, a horizontal axis indicates the distance L between feeding points, and a vertical axis indicates a value of isolation. Further, λ indicates a wavelength corresponding to a representative value of the target frequency band (e.g., a central value of the frequency band or a value of a frequency at which the body part resonates most strongly). Herein, shapes of the body parts 11 and 21, shapes of the coupling parts 12*b* and 22*b*, and a distance between the coupling parts are fixed, and respective lengths of the extending parts 12*a* and 22*a* are changed at an equal ratio, corresponding to the change in distance L between feeding points.

As illustrated in FIG. 5, when the distance L between feeding points is around ½λ, the isolation performance is improved most. When the distance L between feeding points is less than ¼λ (i.e., the distance between the antennas is too small), the effect of the branch parts 12 and 22 is decreased. When the distance L between feeding points exceeds ¾λ, the effect remains in some degrees, but the isolation performance is decreased compared to the case of the distance L between feeding points being around ½λ. Accordingly, with respect to the wavelength λ corresponding to the representative value of the target frequency band, the distance L between feeding points is desirably more than or equal to ¼λ and less than or equal to ¾λ. Note that the distance L between feeding points in this case may be an electrical length other than the physical length. When a dielectric constant is one, the distance L between feeding points as the electrical length coincides with the physical distance. However, when a dielectric constant of a dielectric configuring the substrate 30 is more than one, for example, a value of the electrical length turns more than the physical distance. Therefore, when a dielectric having a large dielectric constant is disposed between the feeding point P1 and the feeding point P2, a required electrical length can be secured, while decreasing the physical distance between those feeding points.

Figure 6:
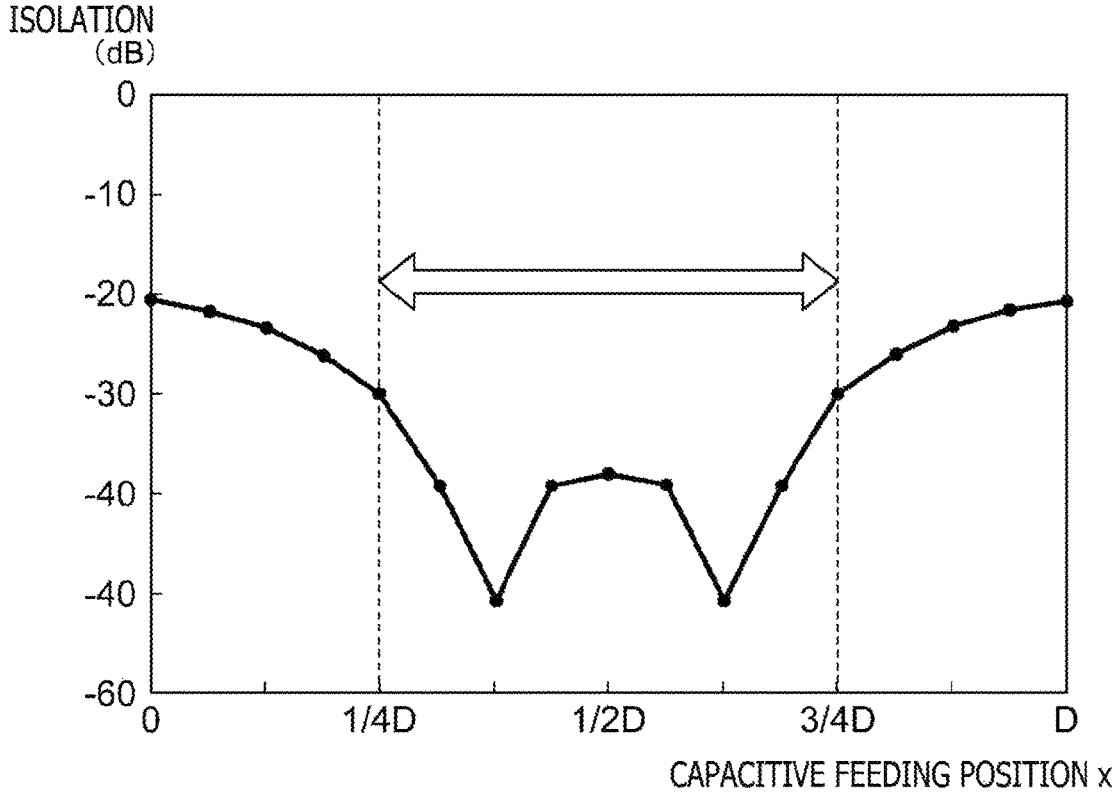
FIG. 6 is a graph illustrating the change in isolation performance when a capacitive coupling position is changed.

Next, FIG. 6 illustrates a change in isolation performance when a capacitive coupling position (i.e., a position where the coupling part 12*b* and the coupling part 22*b* face each other) is changed. In this graph, a horizontal axis indicates a capacitive coupling position x, and a vertical axis indicates a value of isolation. Herein, the shapes of the body parts 11 and 21, the shapes of the coupling parts 12*b* and 22*b*, the distance between the coupling parts, and the distance L between feeding points are fixed, and respective lengths of the extending parts 12*a* and 22*a* are adjusted to change the capacitive coupling position. A case where the capacitive coupling position is closest to the body part 21 (when the length of the extending part 22*a* is zero) is expressed as x=0. In contrast, a case where the capacitive coupling position is closest to the body part 11 (when the length of the extending part 12*a* is zero) is expressed as x=D. Therefore, x=½D indicates a case where the lengths of the extending parts 12*a* and 22*a* are set equal to each other, and the capacitive coupling position is located at a central position between the body part 11 and the body part 21 (a position having equal distances to the body part 11 and the body part 21).

As illustrated in FIG. 6, the isolation performance can be improved even with a state in which the capacitive coupling position is made closer to any one of the antennas. However, when the capacitive coupling position is disposed around the center of two antennas, the isolation performance can particularly be improved. It is then desirable that the capacitive coupling position is disposed at a position ranging from ¼D to ¾D, that is, at a position that is closer to a center between the body parts than the distance to any one of the body parts.

With the communication device 1*a* according to the present embodiment described above, each of the two antennas is provided with the branch part that causes the capacitive coupling with the other branch part, other than the body part that resonates in the target frequency band, thereby improving the isolation performance between the two antennas without providing stub or other components outside the antennas.

Second Embodiment

Subsequently, a configuration of a communication device 1*b* according to a second embodiment of the present invention will be described. Note that, hereinafter, a component corresponding to that in the first embodiment is attached with an identical reference sign, and detailed description thereof is omitted.

Similar to the first embodiment, the communication device 1*b* according to the present embodiment is configured to include a first antenna 10, a second antenna 20, and a substrate 30, but is different from the first embodiment in a shape of each antenna, thereby differentiating frequency bands of wireless signals that can be transmitted and received. Specifically, each antenna uses a first target frequency band and a second target frequency band, which are different from each other, to achieve wireless communication. For example, the first target frequency band may be a frequency band around 2.4 GHz, and the second target frequency band may be a frequency band around 5 GHz.

Figure 7:
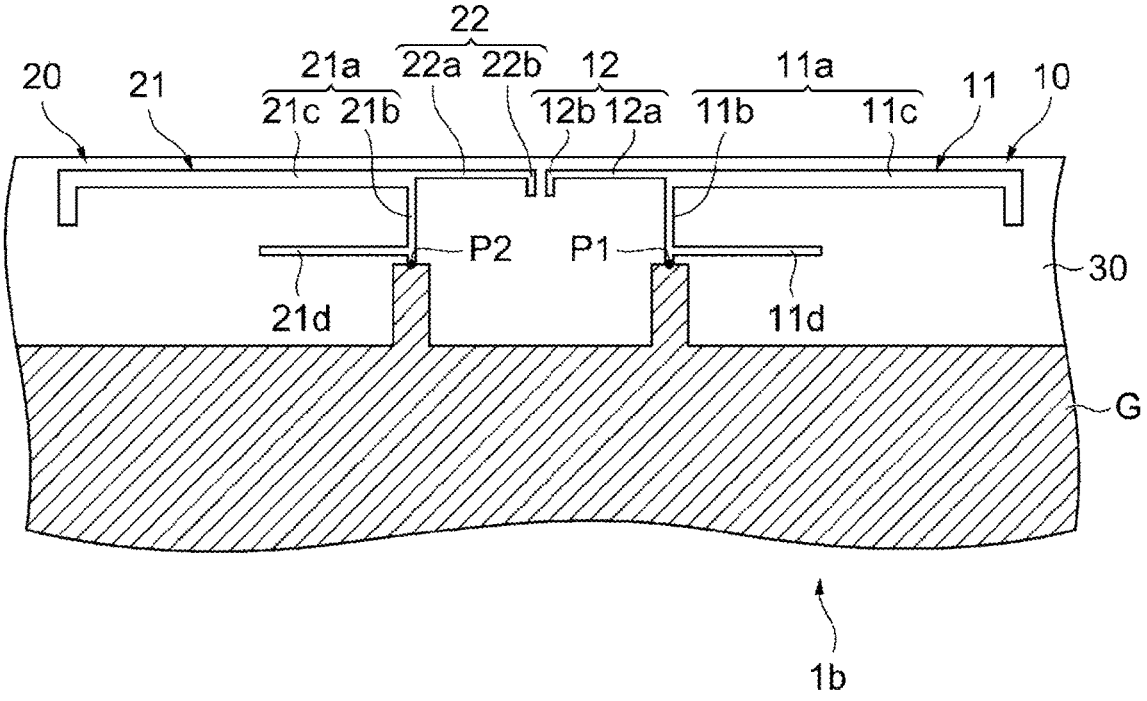
FIG. 7 is a plan view schematically illustrating an internal configuration of a communication device according to a second embodiment of the present invention.

FIG. 7 is a plan view illustrating shapes of the first antenna 10 and the second antenna 20 in the present embodiment. As illustrated in FIG. 7, in the present embodiment, the first antenna 10 is configured to include a body part 11 and a branch part 12. The body part 11 is configured to include a first resonating part 11*a* and a second resonating part 11*d*.

The first resonating part 11*a* is a part that resonates in the first target frequency band. The first resonating part 11*a* is configured to include a base part 11*b* that extends from a feeding point P1 vertical to the substrate 30, and an extension part 11*c* that extends opposite to the second antenna 20 from a tip of the base part 11*b*. A tip of the extension part 11*c* has an L shape that bends toward the feeding point P1, thereby causing the first resonating part 11*a* to have a substantially C shape as a whole. A total length of the first resonating part 11*a* is adjusted to resonate in the first target frequency band.

The second resonating part 11*d* is a part that resonates in the second frequency band. The second resonating part 11*d* is formed by branching from the base part 11*b* of the first resonating part 11*a* at a position near the feeding point P1, and has a linear shape that extends opposite to the second antenna 20. With those two resonating parts, the first antenna 10 can transmit and receive the wireless signal in each of the first target frequency band and the second target frequency band.

Similar to the first embodiment, the branch part 12 is configured to include an extending part 12*a* and a coupling part 12*b*. The extending part 12*a* extends from an end of a side, of the first resonating part 11*a*, closer to the second antenna 20 toward the second antenna 20. The coupling part 12*b* connected to a tip of the extending part 12*a* is disposed to be adjacent to a coupling part 22*b* of the second antenna 20 with an interval left.

Herein, the extension part 11*c* of the first resonating part 11*a* and the extending part 12*a* of the branch part 12 are formed by branching from a tip of the base part 11*b*. A width of the extension part 11*c* is wider than that of the extending part 12*a*. In other words, at a branch point where the branch part 12 branches from the body part 11, a width of the branch part 12 is narrower than a width of the body part 11 that extends ahead from the branch point. With such a shape, magnitude of a current flowing through the body part 11 can be larger than magnitude of a current flowing through the branch part 12.

Similar to the first antenna 10, the second antenna 20 is also configured to include a body part 21 and a branch part 22. The body part 21 is configured to include a first resonating part 21*a* and a second resonating part 22*d*. The first resonating part 21*a* is configured to include a base part 21*b* and an extension part 21*c*. Further, the branch part 22 is configured to include an extending part 22*a* and a coupling part 22*b*. Similar to the first embodiment, also in the present embodiment, the second antenna 20 has a shape similar to the shape of the first antenna 10, and is disposed to be in line symmetry with the first antenna 10. This configuration causes the coupling part 12*b* of the first antenna 10 and the coupling part 22*b* of the second antenna 20, which are disposed adjacent to each other, to be capacitively coupled, thereby causing resonance through paths similar to the third resonance mode and the fourth resonance mode in the first embodiment.

Particularly, in the present embodiment, those resonance modes running through the capacitive coupling causes resonance for canceling influence of both of the resonance in the first target frequency band and the resonance in the second target frequency band. Therefore, by providing the branch part 12 and the branch part 22, the isolation performance can be improved in both of the first target frequency band and the second target frequency band.

Figure 8:
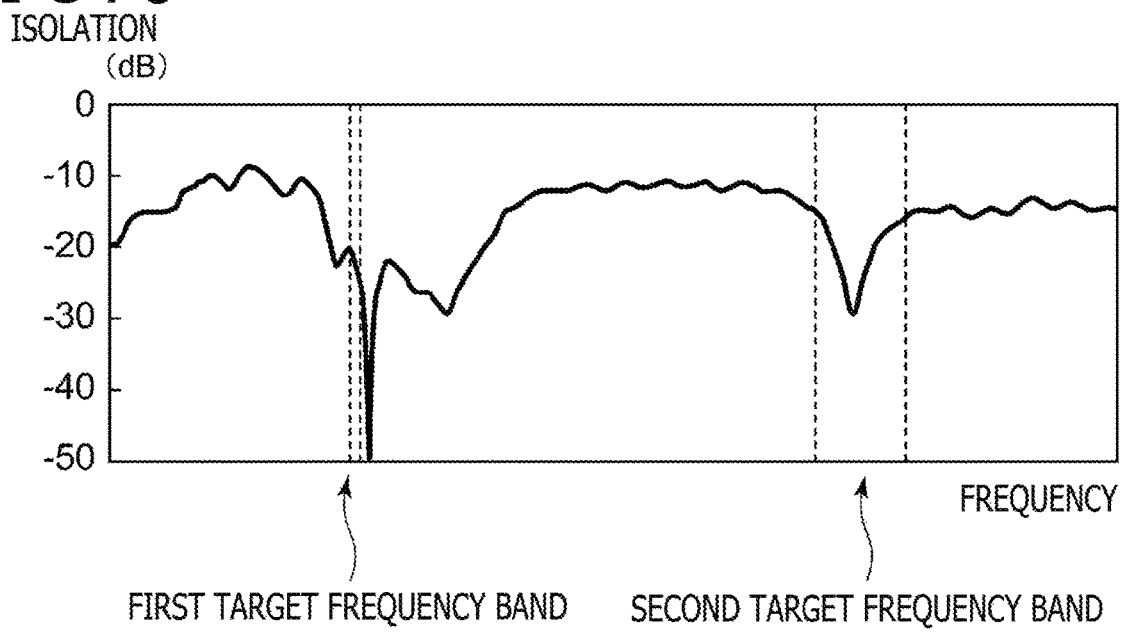
FIG. 8 is a graph illustrating isolation performance between antennas of the communication device according to the second embodiment of the present invention.

FIG. 8 is a graph illustrating the isolation performance between the antennas in the present embodiment, and illustrates an actual measurement result. As illustrated in FIG. 8, with the communication device 1*b* according to the present embodiment, a value of isolation is improved in both of the first target frequency band (herein, a frequency band around 2.4 GHz) and the second target frequency band (herein, a frequency band around 5 GHz). In addition, it has been confirmed that, also with respect to a voltage standing wave ratio (VSWR) and efficiency of each antenna, satisfactory performance can be obtained.

Note that, also in the present embodiment, the capacitive coupling position is preferably a position relatively closer to an intermediate point between the first antenna 10 and the second antenna 20. Further, in a case where a wavelength corresponding to a representative value of the first frequency band is assumed to be $\lambda 1$, and a wavelength corresponding to a representative value of the second frequency band is assumed to be $\lambda 2$, when a distance L between feeding points is more than or equal to $\frac{1}{4}\lambda_1$ and less than or equal to $\frac{3}{4}\lambda_1$, it can be expected that the isolation performance in the first target frequency band is improved. Moreover, when the distance L between feeding points is more than or equal to $\frac{1}{4}\lambda_2$ and less than or equal to $\frac{3}{4}\lambda_2$, it can be expected that the isolation performance in the second target frequency band is improved. Accordingly, it is preferable that the distance L between feeding points satisfies those conditions with respect to both the two wavelengths, but even when the distance L between feeding points satisfies the condition with respect to any one of the two wavelengths, it can be expected that the isolation performance in a specific frequency band can be improved in comparison with a case where any condition is not satisfied.

As described above, with the communication device 1*b* according to the present embodiment, when wireless communication is performed in a plurality of target frequency bands, the isolation performance can be improved in each frequency band without providing stub or other components.

Modifications

The embodiments of the present invention are not limited to those described above. Specifically, the branch part 12 and the branch part 22 may have various shapes as long as the shapes can achieve the capacitive coupling between the antennas. The body part 11 and the body part 21 may also have various shapes as long as the shapes can cause resonance in the target frequency band. The position where the branch part branches from the body part is not also limited to the end on the side spaced away from the ground, and may be various locations. Also with respect to disposing positions of the antennas themselves, in the above description, the two antennas are disposed on one side surface of the substrate in an aligned manner. However, the present invention is not limited to such disposition. Hereinafter, various modifications applicable to the communication device according to the embodiments of the present invention will be described. Note that the modifications to be described below are applicable to any of the first embodiment and the second embodiment described above, but a case where the disposing positions and the shapes of the antennas in the first embodiment are modified (i.e., a case of the configuration in which the body parts 11 and 21 resonate in the single target frequency band) will be described below as a specific example.

Figure 9:
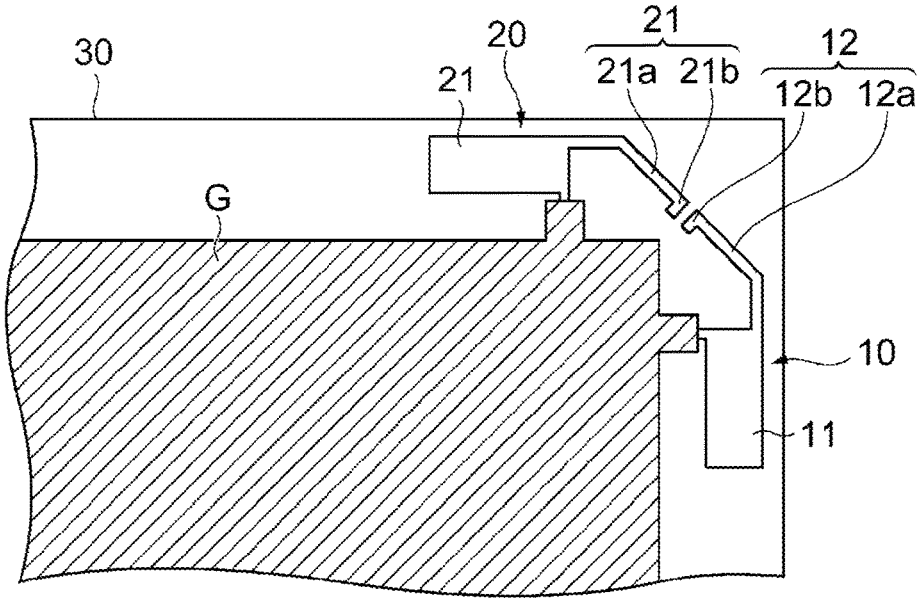
FIG. 9 is a plan view illustrating a first modification of the present invention.

FIG. 9 is a plan view illustrating a shape and disposition of each antenna in a first modification. In this first modification, the first antenna 10 and the second antenna 20 are disposed interposing a corner (vertex) of the ground pattern G formed on the substrate 30. Herein, the two antennas are disposed to be symmetrical with respect to an oblique straight line passing through the vertex of the ground pattern G, and the body part 11 of the first antenna 10 and the body part 21 of the second antenna 20 together form an angle of 90 degrees. Based on this configuration, the extending part 12*a* has a shape that first extends along a direction parallel to a side of the ground pattern G to which the first antenna 10 is connected, and then bends toward the second antenna 20 to form an obtuse angle midway. The extending part 22*a* has a structure similar to the extending part 12*a*, and the extending part 12*a* and the extending part 22*a* are disposed to be symmetrical with each other. With this configuration, even when the body part 11 and the body part 21 are disposed to form the angle of 90 degrees, the coupling parts 12*b* and 22*b* are adjacently disposed with an interval left, thereby enabling the conductive coupling.

Figure 10:
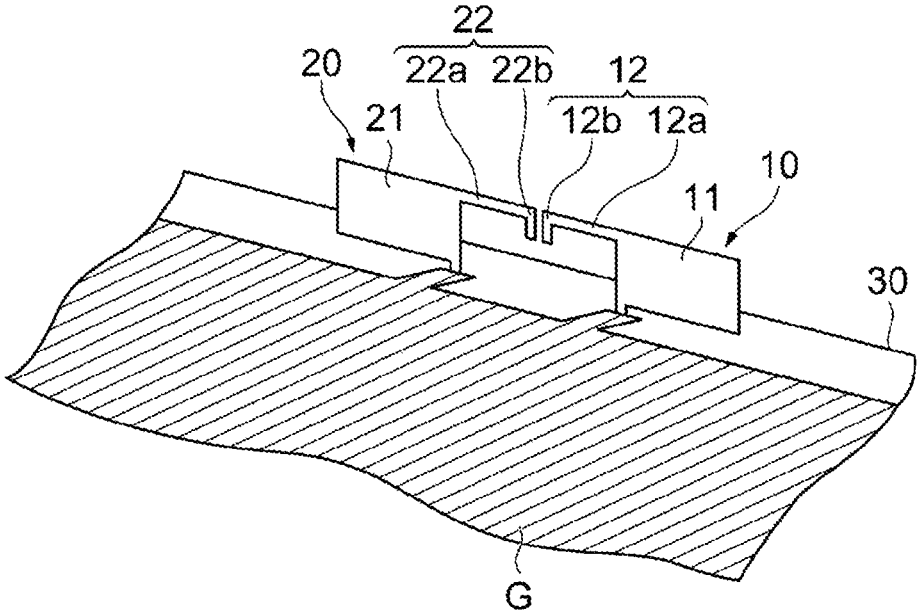
FIG. 10 is a perspective view illustrating a second modification of the present invention.

FIG. 10 is a perspective view illustrating a shape and disposition of each antenna in a second modification. In the above description, the first antenna 10 and the second antenna 20 are both formed on the substrate 30 in a flat shape. However, in this second modification, each of the first antenna 10 and the second antenna 20 is formed from a flat conductive material fixed to a surface of the substrate 30 so as to rise along a thickness direction of the substrate 30. Also in this second modification, the first antenna 10 and the second antenna 20 are formed in a substantially identical plane. With this configuration, the coupling part 12*b* and the coupling part 22*b* are disposed to face each other in the identical plane.

Figure 11:
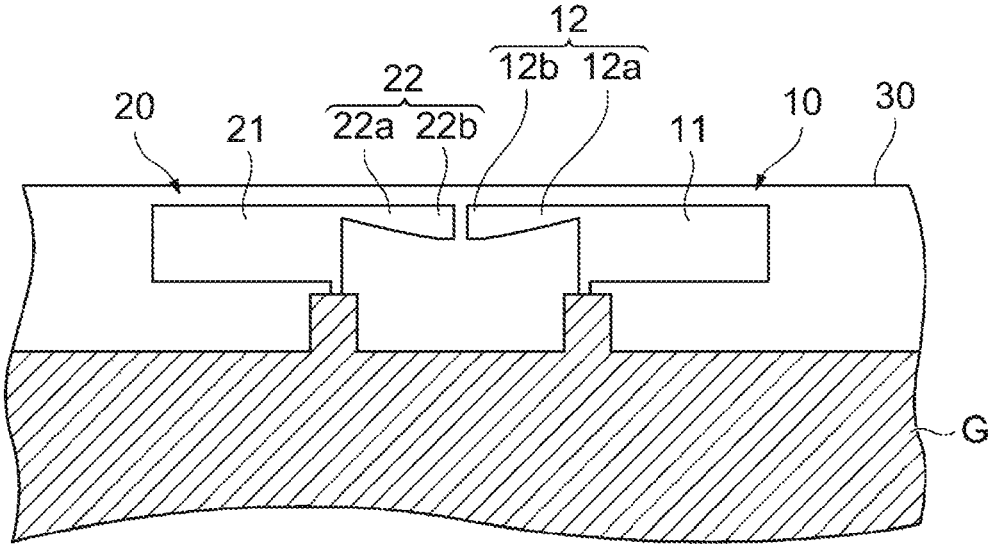
FIG. 11 is a plan view illustrating a third modification of the present invention.

FIG. 11 is a plan view illustrating a shape and disposition of each antenna in a third modification. This third modification is different from the first embodiment in respective shapes of the branch parts 12 and 22. Specifically, each of the branch parts 12 and 22 has a substantially trapezoidal shape, and its width becomes wider when advancing toward its tip after branching from the body part. Also with this configuration, in each of the branch parts 12 and 22, a width at a coupling position (a position to be conductively coupled to the other) along an extending direction is wider than a width at a branch position (a position to be connected to the body part), thereby facilitating the conductive coupling.

Figure 12:
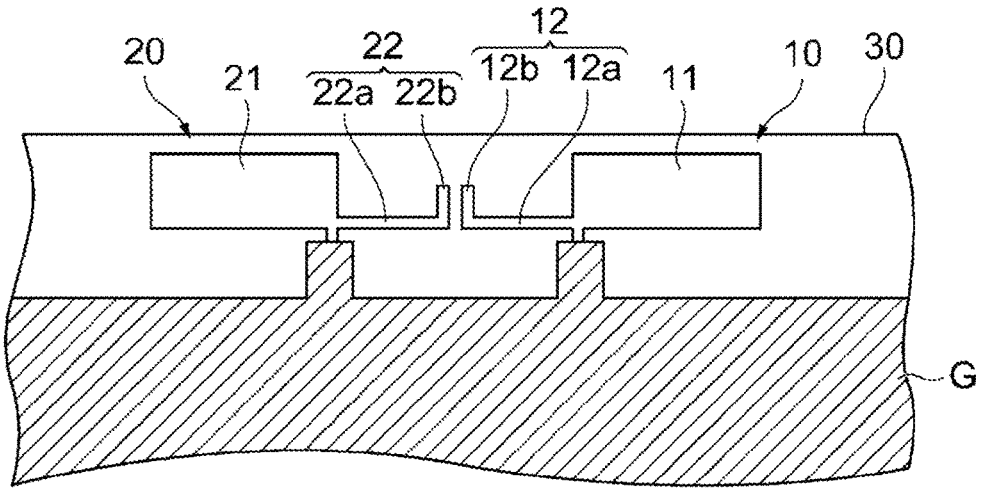
FIG. 12 is a plan view illustrating a fourth modification of the present invention.

FIG. 12 is a plan view illustrating a shape and disposition of each antenna in a fourth modification. This fourth modification is different from the above modifications in a connection position (branch position) in each of the branch parts 12 and 22 to the corresponding body part. In other words, the branch part 12 branches from an end of a side, of the body part 11, closer to the second antenna 20. However, the branch part 12 branches not from a side spaced away from the ground, but from a side closer to the ground. The same applies to the branch part 22. Note that the branch position where the branch part branches from the body part is not limited to the modifications described above, and may be any position.

Figure 13:
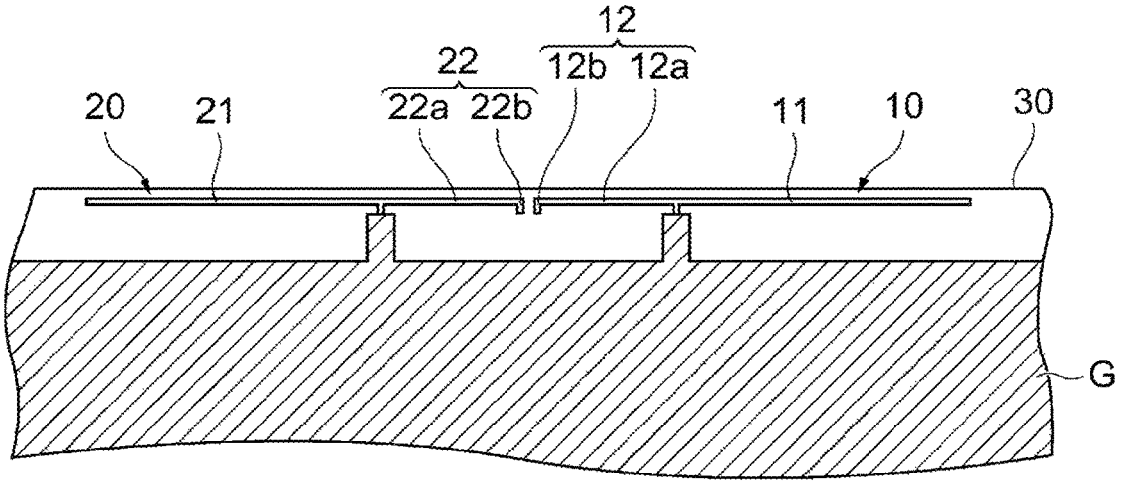
FIG. 13 is a plan view illustrating a fifth modification of the present invention.

FIG. 13 is a plan view illustrating a shape and disposition of each antenna in a fifth modification. This fifth modification is different from the above modifications in respective shapes of the body parts 11 and 21. Specifically, each of the body parts 11 and 21 has a rod shape that extends opposite to the corresponding branch part. Also in this case, the body parts 11 and 21 enable the wireless communication in the target frequency band.

Figure 14:
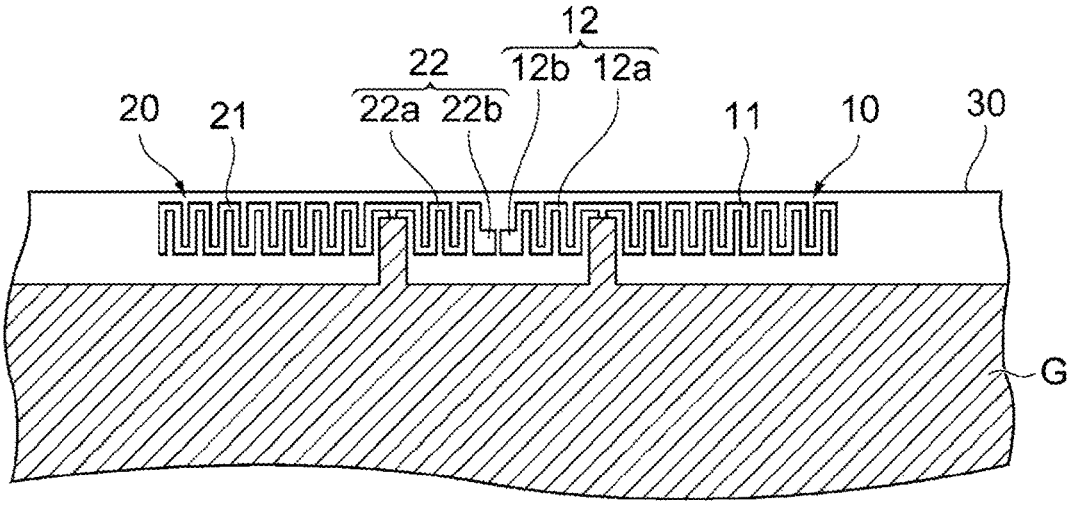
FIG. 14 is a plan view illustrating a sixth modification of the present invention.

FIG. 14 is a plan view illustrating a shape and disposition of each antenna in a sixth modification. This sixth modification is different from the above modifications in shapes of both the body part and the branch part. Both parts each have a meandering shape that bends a plurality of times to meander. With this shape, a distance of the antenna can be made longer within a relatively narrow range. This allows to dispose an antenna that performs wireless communication in, for example, a relatively low frequency band with a saved space. Note that herein, both the body part and the branch part have the meandering shape, but any one of the body part and the branch part may have the configuration described in the present modification.

Figure 15:
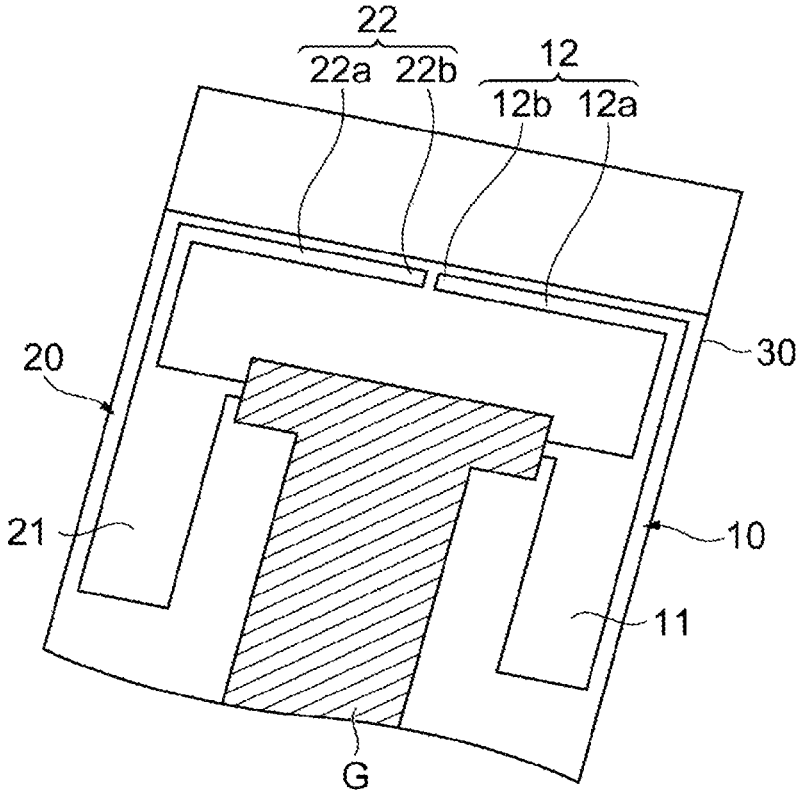
FIG. 15 is a perspective view illustrating a seventh modification of the present invention.

FIG. 15 is a perspective view illustrating a shape and disposition of each antenna in a seventh modification. In this seventh modification, the first antenna 10 and the second antenna 20 are disposed in opposite directions to each other interposing the ground pattern G on the substrate 30. With this configuration, the extending parts 12*a* and 22*a* each have a shape that bends to form an angle of 90 degrees, and face each other at an intermediate position between the antennas, after bending.

Furthermore, in the present modification, each of the coupling parts 12*b* and 22*b* is not formed to have a wider width than that of the corresponding extending part, and has the same width as a width of a branch position where the branch part branches from the body part. In this manner, as long as conductive coupling of a degree allowing occurrence of the resonance mode running through the branch parts can be obtained, the coupling part is not necessarily formed to have the wider width.

Figure 16:
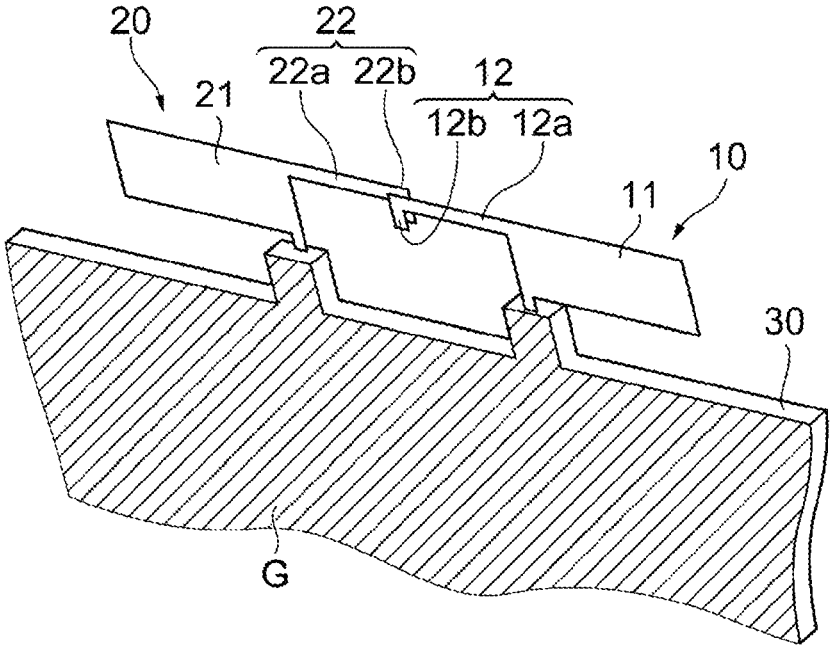
FIG. 16 is a perspective view illustrating an eighth modification of the present invention.

FIG. 16 is a perspective view illustrating a shape and disposition of each antenna in an eighth modification. In all modifications described above, the first antenna 10 and the second antenna 20 are disposed in the identical plane. Note that in the second modification, the antennas are not disposed on the substrate 30, but the first antenna 10 and the second antenna 20 are disposed on the identical plane to cause the conductive coupling while causing the coupling parts to face each other. However, in this eighth modification, the first antenna 10 and the second antenna 20 are disposed on planes different from and parallel to each other, respectively. More specifically, herein, the substrate 30 is assumed to be a multilayered substrate, and the first antenna 10 and the second antenna 20 are assumed to be connected to layers different from each other of the substrate 30, respectively, and to be each disposed on an identical plane to the connected layer.

In this modification, the coupling part 12*b* and the coupling part 22*b* are disposed to overlap each other in plan view (i.e., viewed from a direction vertical to a surface of the substrate 30). In other words, in the above modifications, the coupling part 12*b* and the coupling part 22*b* are disposed to face each other in the identical plane. In contrast, in the present modification, the coupling part 12*b* and the coupling part 22*b* are disposed along the direction vertical to the surface of the substrate 30 (a thickness direction of the substrate 30) with an interval left, thereby allowing such disposition to cause the conductive coupling. Such disposition can also cause resonance running through the conductive coupling, which can improve isolation.

Figure 17:
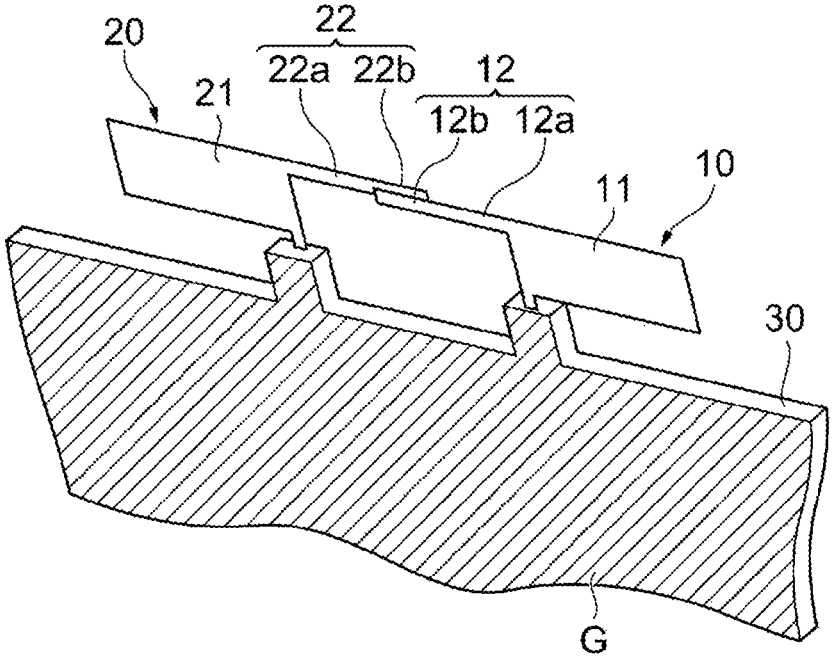
FIG. 17 is a perspective view illustrating a ninth modification of the present invention.

FIG. 17 is a perspective view illustrating a shape and disposition of each antenna in a ninth modification. In this modification in FIG. 17, similar to the eighth modification, the first antenna 10 and the second antenna 20 are disposed on planes different from and parallel to each other, respectively. The coupling part 12*b* at a tip of the branch part 12 and the coupling part 22*b* at a tip of the branch part 22 are disposed to overlap each other in plan view with an interval left.

Also with the present modification, similar to the seventh modification, a width of each of the coupling parts 12*b* and 22*b* substantially coincides with a width at the corresponding branch position. However, by adjusting an overlapping area in plan view, required conductive coupling can be secured.

Figure 18:
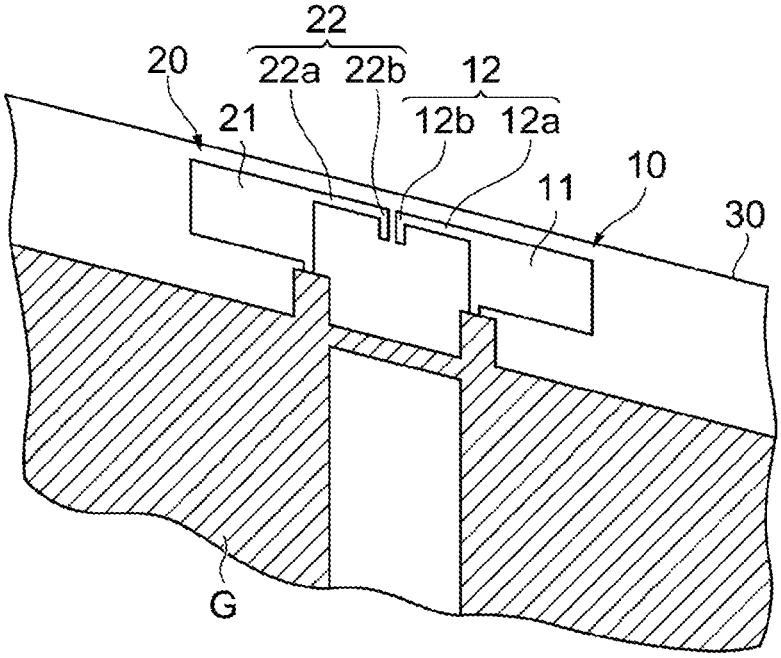
FIG. 18 is a perspective view illustrating a tenth modification of the present invention.

FIG. 18 is a perspective view illustrating a tenth modification. In the above modifications, the shape and disposition of each antenna are different from those in the first embodiment. However, in the present modification, shapes and disposition of the first antenna 10 and the second antenna 20 are similar to those in the first embodiment, but the shape of the ground pattern G formed on the substrate 30 is different from that in the first embodiment. As illustrated in FIG. 18, the shape of the ground pattern G may be any shape, and the first antenna 10 and the second antenna 20 may be disposed adjacent to the ground pattern G, different from the above modifications. Note that the first antenna 10 and the second antenna 20 should be connected to the identical ground to cause resonance running through the conductive coupling.

Note that the features of each modification described above may be combined and applied in any way. For example, antennas each of which has a branch part having a meandering shape may respectively be connected to layers different from each other of a multilayered substrate.

REFERENCE SIGNS LIST

1*a*, 1*b* Communication device, 10 First antenna, 20 Second antenna, 11, 21 Body part, 12, 22 Branch part, 12*a*, 22*a* Extending part, 12*b*, 22*b* Coupling part, 30 Substrate.

The invention claimed is:

1. A communication device comprising:

a first antenna and a second antenna that perform wireless communication in frequency bands that at least partly overlap each other, wherein each of the first antenna and the second antenna includes a body part that resonates in a frequency band that is a target of the wireless communication with each of the first antenna and the second antenna, and a branch part that branches from the body part, and each of the branch part of the first antenna and the branch part of the second antenna includes a coupling part, the coupling part in the first antenna and the coupling part in the second antenna being disposed with an interval left to cause capacitive coupling, wherein at least one of:

the coupling part of the each of the first antenna and the second antenna has a width wider than a width at a branch position where the branch part branches from the body part in the each of the first antenna and the second antenna, the second antenna is disposed on a plane different from and parallel to a plane disposed with the first plane, and the coupling part in the first antenna and the coupling part in the second antenna are disposed to overlap each other in plan view, an electrical length between a feeding point of the first antenna and a feeding point of the second antenna is more than or equal to ¼ and less than or equal to ¾ of a wavelength of an electromagnetic wave corresponding to a representative value of the frequency band, and a width of the branch part of the each of the first antenna and the second antenna at the branch position where the branch part branches from the body part is narrower than a width of the body part extending ahead from the branch position.

2. A communication device, comprising:

a first antenna and a second antenna that perform wireless communication in frequency bands that at least partly overlap each other, wherein each of the first antenna and the second antenna includes a body part that resonates in a frequency band that is a target of the wireless communication with each of the first antenna and the second antenna, and a branch part that branches from the body part, and each of the branch part of the first antenna and the branch part of the second antenna includes a coupling part, the coupling part in the first antenna and the coupling part in the second antenna being disposed with an interval left to cause capacitive coupling, wherein at least one of:

the coupling part of the each of the first antenna and the second antenna has a width wider than a width at a branch position where the branch part branches from the body part in the each of the first antenna and the second antenna, an electrical length between a feeding point of the first antenna and a feeding point of the second antenna is more than or equal to ¼ and less than or equal to ¾ of a wavelength of an electromagnetic wave corresponding to a representative value of the frequency band, and a width of the branch part of the each of the first antenna and the second antenna at the branch position where the branch part branches from the body part is narrower than a width of the body part extending ahead from the branch position.

3. The communication device according to claim 2, wherein the coupling part in the first antenna and the coupling part in the second antenna are disposed to face each other in an identical plane.

4. The communication device according to claim 1, wherein the branch part of one of the first antenna and the second antenna branches from an end on a side, of the body part, closer to another one of the first antenna and the second antenna, the end being spaced away from a ground connected with the one of the first antenna and the second antenna.

5. The communication device according to claim 1, wherein a position disposed with the coupling part of the each of the first antenna and the second antenna is a position closer to a center position between the body part of the first antenna and the body part of the second antenna than the body part of the each of the first antenna and the second antenna.

* * * * *